US005485953A

United States Patent [19]

Bassett et al.

[11] Patent Number: 5,485,953

[45] Date of Patent: Jan. 23, 1996

[54] METHOD AND APPARATUS FOR CONTROLLING THE CIRCULATION OF HEAT TRANSFER FLUID FOR THERMAL CONDITIONING SYSTEMS FOR SPACES

[75] Inventors: William W. Bassett, Wheaton, Ill.; Robert M. Russ, Los Altos Hills; Thomas L. Webster, Piedmont, both of Calif.

[73] Assignee: Gas Research Institute, Chicago, Ill.

[21] Appl. No.: 378,517

[22] Filed: Jan. 26, 1995

[51] Int. Cl.[6] ..... F24F 7/00

[52] U.S. Cl. ..... 236/49.3; 165/22

[58] Field of Search ..... 165/22; 236/11, 236/49.3

[56] References Cited

U.S. PATENT DOCUMENTS 4,773,472 9/1988 Aoki et al. ..... 165/22

5,303,767 4/1994 Riley ..... 165/22

*Primary Examiner*—John M. Sollecito

*Attorney, Agent, or Firm*—Dick & Harris

[57] ABSTRACT

A method and apparatus for controlling the circulation of heat transfer fluid for thermal conditioning systems for spaces, in which the temperatures of several at least partially thermally separate spaces are monitored and averaged, and compared with a predetermined set point temperature, for purposes of controlling the operation of a source of thermal conditioning. In addition, the temperature differentials between the several spaces are also monitored, for purposes of controlling the circulation of the heat transfer fluid. The present invention permits the continued circulation of the heat transfer fluid, even if no heating or cooling is required, for purposes of reducing the temperature differentials between the several spaces.

16 Claims, 1 Drawing Sheet

METHOD AND APPARATUS FOR CONTROLLING THE CIRCULATION OF HEAT TRANSFER FLUID FOR THERMAL CONDITIONING SYSTEMS FOR SPACES

BACKGROUND OF THE INVENTION

1. The Field of the Invention

The present invention relates to the field of thermal conditioning systems for spaces, such as, but not limited to, HVAC systems for residential and commercial spaces.

2. The Prior Art

In prior art thermal conditioning systems for spaces, such as HVAC systems for commercial or residential spaces, in which a single zone is established which combines several separate spaces, there is often the possibility of substantial temperature differentials arising between two or more of the separate spaces. This is particularly true when the HVAC system is not supplying either heating or cooling.

For example, a typical two-story house, having a basement, and a single (probably centrally located) thermostat, will have three separate floors comprising a single zone. Depending upon the season, outside ground conditions, solar effects, and the like, each of the three floors may have a prevailing temperature which is substantially different from the temperatures of either of the other floors. If the ground is exceptionally cold, the basement will be cooler than the "norm" established by the thermostat, and if there is strong sunshine, the upper floor may pick up heat and be hotter than the "norm".

A common method of equalizing the temperatures in the several spaces, if the HVAC system is of the sort employing forced circulating air, would be for the owner to switch to the "FAN-ON" setting on the thermostat, so that the blower is operating, even if the furnace or air conditioner is not. While this method may reduce the temperature differentials between the floors (or spaces), it does so at the potential cost of substantially increased electricity bills, increased noise, manual operation of the thermostat, increased dust and airborne particle circulation, etc.

It is therefore desirable to provide a method of operation of a single-zone thermal conditioning system for a plurality of spaces, which is capable of automatically sensing excessive temperature differentials between the several spaces, and modifying its operation so as to substantially reduce or eliminate such temperature conditions.

SUMMARY OF THE INVENTION

The present invention comprises, in part, a method for controlling the circulation of heated heat transfer fluid for thermal conditioning systems having at least partially thermally separate spaces, in which the thermal conditioning system includes a source of thermal conditioning, and a means for circulating heat transfer fluid from the source of thermal conditioning to the thermally separate spaces, such that heat may be transferred between the source of thermal conditioning and the heat transfer fluid, and between the heat transfer fluid and the thermally separate spaces.

In particular, the method comprises the steps of sensing the temperature in each of the thermally separate spaces;

determining, at predetermined intervals of time, a calculated sensed temperature, based upon the temperatures sensed by the sensors;

comparing tile calculated sensed temperature against a predetermined range of temperatures; and, if the calculated sensed temperature is within the predetermined range, the following steps; of determining the differentials between the sensed temperatures, comparing the determined temperature differential of the greatest absolute value against a predetermined temperature differential absolute value, and adjusting the flow of the heat transfer fluid if the greatest determined temperature differential value exceeds the predetermined temperature differential value.

In a preferred embodiment, the method further comprises the step of determining whether the calculated sensed temperature is above or below the predetermined range of temperatures, if the calculated sensed temperature is outside the predetermined range of temperatures. The next step is to adjust the rate of operation of the source of thermal conditioning, so as to transfer less heat to, or remove more heat from, the heat transfer fluid, if the calculated sensed temperature is above the predetermined range of temperatures. Alternatively, the next step is to adjust the rate of operation of the source of thermal conditioning, so as to transfer more heat to, or remove less heat from, the heat transfer fluid, if the calculated sensed temperature is below the predetermined range of temperatures.

The following alternative steps are included in the method according to the present invention:

determining the differentials between the sensed temperatures, comparing the determined temperature differential of the greatest absolute value against a predetermined temperature differential absolute value, and adjusting the flow rate of the heat transfer fluid to a minimum predetermined rate appropriate in relation to the rate of operation of the thermal conditioning means.

The present invention also includes an apparatus for controlling the circulation of heated heat transfer fluid in a thermal conditioning system for at least partially thermally separate spaces, in which the thermal conditioning system includes a source of thermal conditioning, and means for circulating heat transfer fluid from the source of thermal conditioning to the two or more separate spaces, such that heat may be transferred between the source of thermal conditioning and the heat transfer fluid, and between the heat transfer fluid and the at least partially thermally separate spaces.

In particular, the apparatus comprises means for sensing temperature, operably disposed in each of the at least partially thermally separate spaces; means, operably associated with the source of thermal conditioning, the means for circulating heat transfer fluid and the means for sensing temperature, for regulating the actuation and speed of operation of the source of thermal conditioning and the means for circulating heat transfer fluid; means for determining, at predetermined intervals of time, an average sensed temperature, based upon the temperatures sensed by the sensors; means for comparing the calculated average sensed temperature against a predetermined range of temperatures, means for determining if the calculated average sensed temperature is within the predetermined range, and means for determining the differentials between the sensed temperatures, means for comparing the determined temperature differential of the greatest absolute value against a predetermined temperature differential absolute value, and means for increasing the flow of the heat transfer fluid if the calculated average sensed temperature is determined to be within the predetermined range and the greatest determined temperature differential value is determined to exceed the predetermined temperature differential value.

The apparatus according to the present invention further comprises means for determining whether the average sensed temperature is above or below the predetermined range of temperatures, if the average sensed temperature is outside the predetermined range of temperatures.

The apparatus according to a preferred embodiment also comprises means for adjusting the rate of operation of the source of thermal conditioning, so as to transfer less heat to, or remove more heat from, the heat transfer fluid, if the calculated sensed temperature is above the predetermined range of temperatures.

Alternatively, the apparatus may comprise means for adjusting the rate of operation of the source of thermal conditioning, so as to transfer more heat to, or remove less heat from, the heat transfer fluid, if the calculated sensed temperature is below the predetermined range of temperatures.

The apparatus of the present invention may also include means for determining the differentials between the sensed temperatures, means for comparing the determined temperature differential of the greatest absolute value against a predetermined temperature differential absolute value, and means for adjusting the flow rate of the heat transfer fluid to a minimum predetermined rate appropriate in relation to the rate of operation of the thermal conditioning means.

BEST MODE FOR PRACTICING THE INVENTION

Figure 1:
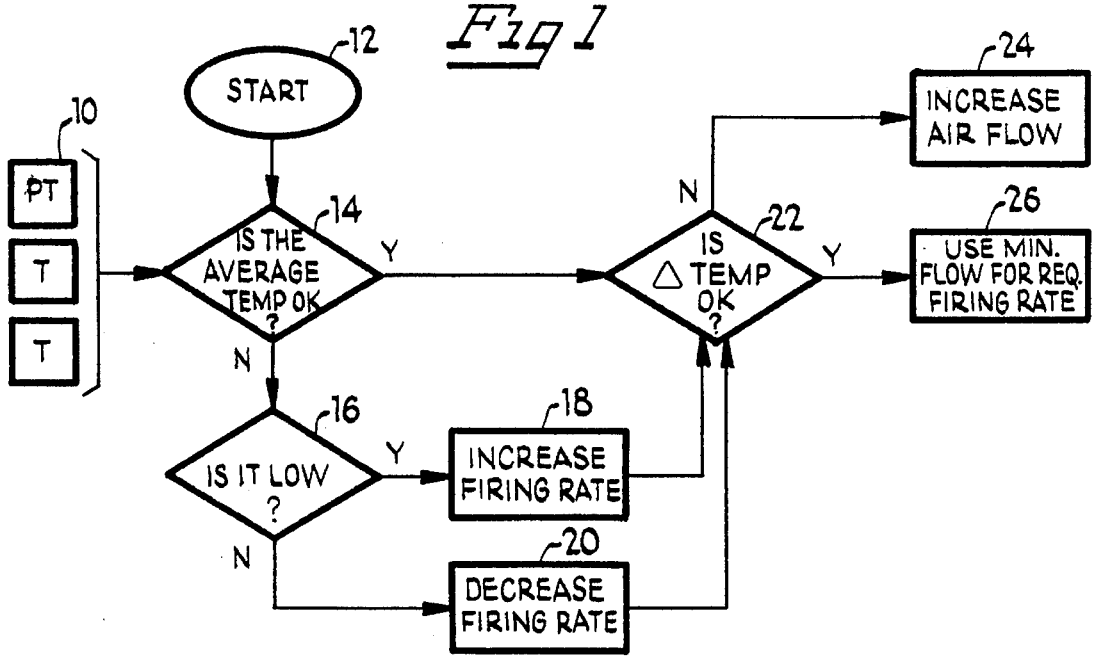
FIG. 1 is a flowchart illustrating operation of the method according to the present invention when the thermal conditioning system is in a heating mode of operation.

While this invention is susceptible of embodiment in many different forms, there is shown in the drawings and will be described in detail herein, one or more preferred embodiments, with the understanding that the present disclosure is to be considered as an exemplification of the principles of the invention, and is not intended to limit the invention to the embodiment(s) illustrated.

In a preferred embodiment of the invention, the spaces to be thermally conditioned, will be served by an HVAC system, comprising a gas-fired heat puma capable of heating and cooling, or a gas-fired furnace with a circulating air blower and an air-conditioner unit with coolant coils passing through the plenum of the furnace. The HVAC system may also include a combustion air inducer or a power burner arrangement for the heat pump or furnace. However, it will be understood that the principles explained will be equally applicable to other types of HVAC systems, such as electrically operated units.

The heat pump or furnace may be provided with a modulating gas valve, which is capable of providing a substantially infinite variation of firing rates for the heat pump burner or furnace, within defined maximum and minimum firing rates—although non-modulating valves are also contemplated for use. The circulating air blower may likewise be provided with a motor (such as an electrically commutated motor or ECM) which will enable the blower speed to be infinitely variable within maximum and minimum speeds.

Each floor or separate occupied space may be provided with its own control thermostat or sensor, wherein each may connect to a master programmable controller connected to the furnace, blower motor, air conditioner, inducer, etc., as may be desired or as the installation requirements dictate.

In the previous example of a two-story home having a basement, a simplified set up for the thermostats would be to have the first floor thermostat be configured and programmed to perform as a main or primary thermostat. Such a thermostat may be configured to have temperature and timing programming features, such as are found in existing programmatic thermostats. In addition, the main or primary thermostat would communicate set point and room temperature settings to the furnace master controller.

A simplified temperature sensor could be employed in the basement and the second floor, and would, as a minimum function, communicate the actual room temperature to the master controller in the furnace. Alternatively, as described in further detail hereinafter, a more complex device, approaching the primary thermostat in function, could be provided for each separate floor or space. It is contemplated that the floors or spaces may be at least partially thermally separate from one another, but total thermal isolation is not required. However, for a single zone HVAC system, only one thermostat at a time can actually function as a thermostat (as opposed to functioning as a simple temperature sensor).

The general operation of the HVAC system, utilizing the control method of the present invention, during a heating season or heating mode, is depicted in the flowchart of FIG. 1. The primary thermostat (PT) 10 will be programmed with a desired set point temperature. After the heating (or cooling) operation has stopped, at predetermined preprogrammed intervals of time, the master controller in the furnace (starting, for example, at start time 12) will poll the several temperature sensors/thermostats and calculate an average "sensed" temperature, based upon the temperatures reported.

The calculated average temperature is compared, at step 14, to a predetermined preprogrammed range of acceptable temperatures, around the set point temperature.

If the calculated average temperature is within the range of acceptable temperatures, the temperatures reported by the several sensors/thermostats are then examined, at step 22, by the master controller and the various temperature differentials are calculated. If greatest of the temperature differentials exceeds a predetermined value (for example, 4° F.), then the circulating air blower is either started, or if already running, its speed is increased at step 24. The blower is then run at the increased speed, or at an initial speed, so as to effectively circulate the air throughout the several floors or spaces, until the temperature differentials are reduced, that is, until the next time when the master controller polls the sensors/thermostats and a new average temperature is calculated, and the process, as described, is repeated.

If the greatest temperature differential is within acceptable limits, then the circulating air flow rate is set, at step 26, to the lowest rate acceptable for the particular furnace firing rate which has been established, if, in fact, the burner is firing at that point. (For any given firing rate, a minimum circulating air flow rate will be determined for each HVAC system, in order to maintain an acceptable controlled temperature rise in the furnace plenum, as well as for other well-known reasons). Of course, if the average calculated temperature is within the preset limits, and the maximum temperature differential is likewise within preset limits, then no activity of any kind will be required, until one or the other of the calculated values departs from the preset limits.

If the calculated average temperature is outside the range of acceptable temperatures, a determination, at step 16, is also made as to whether the average is above or below the range.

If the average temperature is below the range, the firing rate of the furnace is increased, at step 18, from the rate of the last heating period. Again, the temperature differentials are calculated. If the greatest differential exceeds the predetermined value, then the circulating air flow is increased, at step 24, as described. If the greatest temperature differential is acceptable, then the HVAC system will operate as described hereinabove.

If the average temperature is above the range (an unlikely event, but possible if the heating load were suddenly reduced, for example by a rapid rise in outside temperature, or an extended period of strong solar heating), the firing rate of the furnace (for the next heating period) is lowered, at step 20. The controller may be programmed to respond, in such conditions, by shutting down the furnace entirely.

If the greatest temperature differential exceeds the allowed value, then the blower is started or increased in speed, without the furnace firing. If the differentials are within limits, then the blower will be run at the lowest permissible speed, as previously described, at such time as the average calculated temperature falls to such a point that heating will be required. If the greatest temperature differential is acceptable, then the HVAC system will operate as described hereinabove.

Although the foregoing has described the operation of the method of the present invention during a heating season or heating mode, it will be understood to those with ordinary skill in the art that the invention is also applicable to a cooling operation as well. Although the present invention has been disclosed and discussed relative to the environment of a conventional two-story home with basement, it is to be understood that the principles, methods and apparatus herein may be employed in spaces having other geometries and configurations, so long as the overall space comprises at least partially thermally separate spaces. For example, a single large individual room, such as a correctional hall comprising several thermally separate spaces with different thermal loads and requirements, may employ the principles of the present invention.

Figure 2:
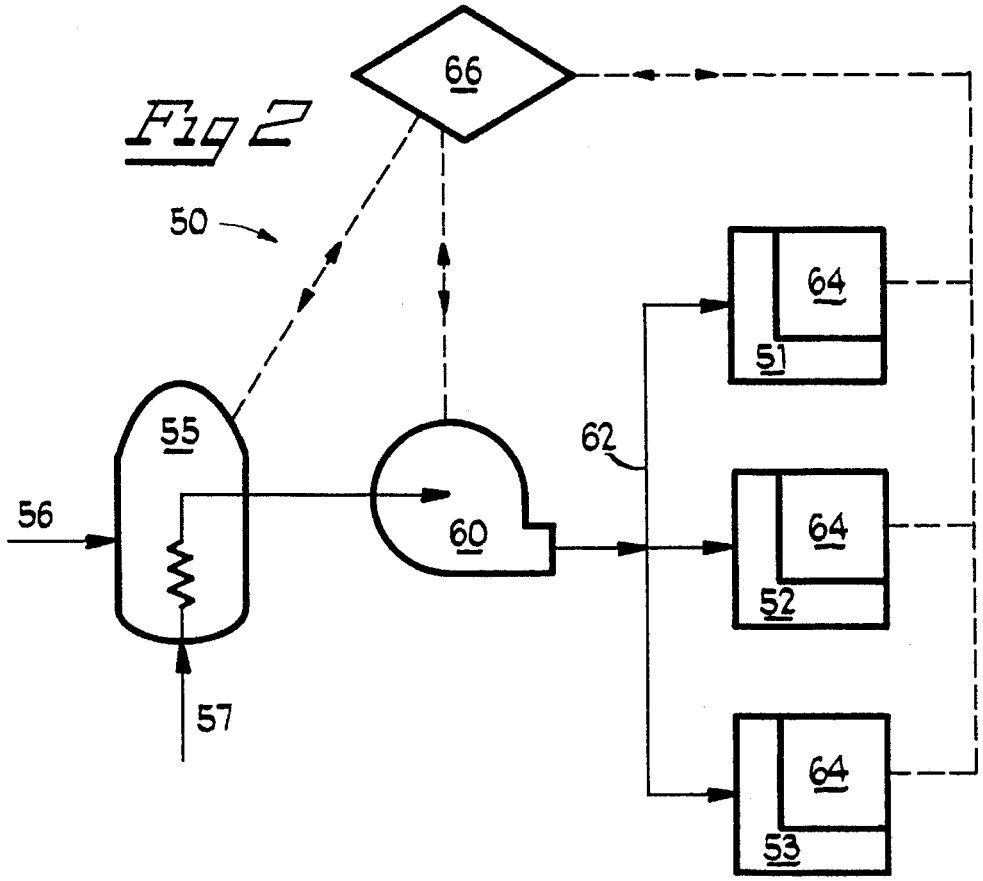
FIG. 2 is a schematic illustration of a thermal conditioning system for a plurality of at least partially thermally separate spaces, incorporating the present invention.

A schematic illustration of a basic thermal conditioning system 50, incorporating the present invention, is provided in FIG. 2, for the thermal conditioning of two or more at least partially thermally separate spaces 51–53. Thermal conditioning apparatus 55 may be a gas-fired heat pump with (for example) an absorption heat exchanger-evaporator-condenser configuration, a gas-fired furnace and an air conditioner unit, or a boiler—although non gas-fired units are likewise contemplated. Thermal conditioning unit 55 receives fuel (such as natural gas) at 56, and receives at 57, in a heat exchange relationship, a heat transfer fluid, such as circulating air, water or steam. After coming from thermal conditioning unit 55 (and possibly having exchanged heat with the thermal conditioning unit 55), the heat transfer fluid is drawn to, and propelled by heat transfer fluid circulating apparatus 60, which may be a blower, or a pump. From circulating apparatus 60, the heat transfer fluid is conducted by ducts (or piping) 62, to spaces 51–53.

Each space 51–53, will have a sensor/thermostat 64 located therein, each of which is connected to master controller 66, as previously described. Master controller 66, which may be a programmable microprocessor or similar apparatus, of known construction, will be appropriately connected to thermal conditioning apparatus 55 and circulating apparatus 60 and will be programmed, using known techniques, to carry out the previously-described control methods according to the present invention.

In an alternative preferred embodiment, each floor or separate occupied space will be provided with a programmable thermostat. The overall HVAC system will be suitably programmed such that, at any given time, only one of the thermostats will function as a thermostat ("primary thermostat" as previously described), and be capable of calling for heating, cooling, or "FAN-ON" mode operations. Additional suitable programming will enable the owner-operator to shift the function of the primary thermostat from one occupied space to another.

For example, at night during a cooling season, an upstairs occupied space will tend to overheat, relative to lower level spaces. In that instance, the primary thermostat function could be shifted to an upstairs thermostat. Similarly, since heated air tends to be buoyant, during heating season, the primary thermostat function would also be moved upstairs, thus permitting the lower (and presumably unoccupied) spaces, to be slightly cooler, though within the temperature differential limits imposed by the method, as herein described.

The master controller could also be programmed to schedule its functions based upon inputs from the sensors/thermostats during different periods during a day. For example, during periods when the house is unoccupied, the controller could be programmed to disable the "FAN-ON" mode, and cycle in a customary fashion, or in a modulating mode, responding to the input of just the primary thermostat.

The controller could also be programmed to have a set point which is obtained from averaging the temperatures reported by all the sensors, instead of a set point based at just one primary thermostat. Additional programming could be provided which would prevent operation in the "FAN-ON" mode, if specific individual rooms or spaces exceed preselected absolute or differential temperature limits.

The several preferred embodiments discussed herein have been discussed in relation to an HVAC system which is supplied with a gas-fired furnace having a modulating gas valve. However, it will also be understood to those with ordinary skill in the art that the present invention would also be applicable in other HVAC environments.

A thermal conditioning system configured in accordance with the method and apparatus of the present invention would be capable of fully automatic operation, and would run the blower only when necessary to maintain predetermined minimum temperature differentials, thus potentially significantly reducing electrical power consumption. Such a system is believed to be more economical to operate than the manual "FAN-ON" operations of the prior art. The comfort level and noise levels in the spaces would be improved. Further, such a system would have effects similar to those produced with a multizone system, but with reduced initial costs and operating costs. In a system in which each temperature sensor is a programmable thermostat, the primary thermostat function would be easily and readily moved from floor to floor or room to room, to maintain it in the floor or room in which it is most important to maintain the correct, most controlled temperature.

The foregoing description and drawings merely serve to illustrate the invention and the invention is not limited thereto except insofar as the appended claims are so limited, as those skilled in the art who have the disclosure before them will be able to make modifications and variations therein without departing from the scope of the invention.

We claim:

1. A method for controlling the circulation of heat transfer fluid for thermal conditioning systems for at least partially thermally separate spaces, in which the thermal conditioning system includes a source of thermal conditioning, and a means for circulating heat transfer fluid from the source of thermal conditioning to the at least partially thermally separate spaces, such that heat may be transferred between the source of thermal conditioning and the heat transfer fluid, and between the heat transfer fluid and the at least partially thermally separate spaces, the method comprising:

sensing the temperature in each of the at least partially thermally separate spaces;

determining, at predetermined intervals of time, a calculated sensed temperature, based upon the temperatures sensed by the sensors;

comparing the calculated sensed temperature against a predetermined range of temperatures; and, if the calculated sensed temperature is within the predetermined range, the following steps of determining the differentials between the sensed temperatures, comparing the determined temperature differential of the greatest absolute value against a predetermined temperature differential absolute value, and increasing the flow of the heat transfer fluid if the greatest determined temperature differential value exceeds the predetermined temperature differential value.

2. The method according to claim 1, further comprising the step of:

determining whether the calculated sensed temperature is above or below the predetermined range of temperatures, if the calculated sensed temperature is outside the predetermined range of temperatures.

3. The method according to claim 2, further comprising the step of:

adjusting the rate of operation of the source of thermal conditioning, so as to transfer less heat to, or remove more heat from, the heat transfer fluid, if the calculated sensed temperature is above the predetermined range of temperatures.

4. The method according to claim 2, further comprising the step of:

adjusting the rate of operation of the source of thermal conditioning, so as to transfer more heat to, or remove less heat from, the heat transfer fluid, if the calculated sensed temperature is below the predetermined range of temperatures.

5. The method according to claim 3, further comprising the steps of:

determining the differentials between the sensed temperatures, comparing the determined temperature differential of the greatest absolute value against a predetermined temperature differential absolute value, and increasing the flow of the heat transfer fluid if the greatest determined temperature differential value exceeds the predetermined temperature differential value.

6. The method according to claim 4, further comprising the steps of:

determining the differentials between the sensed temperatures, comparing the determined temperature differential of the greatest absolute value against a predetermined temperature differential absolute value, and increasing the flow of the heat transfer fluid if the greatest determined temperature differential value exceeds the predetermined temperature differential value.

7. The method according to claim 3, further comprising the steps of:

determining the differentials between the sensed temperatures, comparing the determined temperature differential of the greatest absolute value against a predetermined temperature differential absolute value, and adjusting the flow rate of the heat transfer fluid to a minimum predetermined rate appropriate in relation to the rate of operation of the thermal conditioning means.

8. The method according to claim 4, further comprising the steps of:

determining the differentials between the sensed temperatures, comparing the determined temperature differential of the greatest absolute value against a predetermined temperature differential absolute value, and adjusting the flow rate of the heat transfer fluid to a minimum predetermined rate appropriate in relation to the rate of operation of the thermal conditioning means.

9. An apparatus for controlling the circulation of heat transfer fluid in a thermal conditioning systems for at least partially thermally separate spaces, in which the thermal conditioning system includes a source of thermal conditioning, and means for circulating heat transfer fluid from the source of thermal conditioning to the at least partially thermally separate spaces, such that heat may be transferred between the source of thermal conditioning and the heat transfer fluid, and between the heat transfer fluid and the at least partially thermally separate spaces, the apparatus comprising:

means for sensing temperature, operably disposed in each of the at least partially thermally separate spaces;

means for regulating the actuation and speed of operation of the source of thermal conditioning and the means for circulating heat transfer fluid, operably associated with the source of thermal conditioning, the means for circulating heat transfer fluid and the means for sensing temperature;

means for determining, at predetermined intervals of time, calculated sensed temperatures, based upon the temperatures sensed by the sensors;

means for comparing the calculated sensed temperature against a predetermined range of temperatures, means for determining if the calculated sensed temperature is within the predetermined range, and means for determining the differentials between the sensed temperatures, means for comparing the determined temperature differential of the greatest absolute value against a predetermined temperature differential absolute value, and means for increasing the flow of the heat transfer fluid if the calculated sensed temperature is determined to be within the predetermined range and the greatest determined temperature differential value is determined to exceed the predetermined temperature differential value.

10. The apparatus according to claim 9, further comprising:

means for determining whether the calculated sensed temperature is above or below the predetermined range of temperatures, if the calculated sensed temperature is outside the predetermined range of temperatures.

11. The apparatus according to claim 10, further comprising:

means for adjusting the rate of operation of the source of thermal conditioning, so as to transfer less heat to, or remove more heat from, the heat transfer fluid, if the calculated sensed temperature is above the predetermined range of temperatures.

12. The apparatus according to claim 10, further comprising:

means for adjusting the rate of operation of the source of thermal conditioning, so as to transfer more heat to, or remove less heat from, the heat transfer fluid, if the calculated sensed temperature is below the predetermined range of temperatures.

13. The apparatus according to claim 11, further comprising:

means for determining the differentials between the sensed temperatures, means for comparing the determined temperature differential of the greatest absolute value against a predetermined temperature differential absolute; value, and means for increasing the flow of the heat transfer fluid if the greatest determined temperature differential value exceeds the predetermined temperature differential value.

14. The apparatus according to claim 12, further comprising:

means for determining the differentials between the sensed temperatures, means for comparing the determined temperature differential of the greatest absolute value against a predetermined temperature differential absolute value, and means for increasing the flow of the heat transfer fluid if the greatest determining temperature differential value exceeds the predetermined temperature differential value.

15. The apparatus according to claim 11, further comprising:

means for determining the differentials between the sensed temperatures, means for comparing the determined temperature differential of the greatest absolute value against a predetermined temperature differential absolute value, and means for adjusting the flow rate of the heat transfer fluid to a minimum predetermined rate appropriate in relation to the rate of operation of the thermal conditioning means.

16. The apparatus according to claim 12, further comprising:

means for determining the differentials between the sensed temperatures, means for comparing the determined temperature differential of the greatest absolute value against a predetermined temperature differential absolute value, and means for adjusting the flow rate of the heat transfer fluid to a minimum predetermined rate appropriate in relation to the rate of operation of the thermal conditioning means.

* * * * *